US007726156B2

(12) United States Patent
Hagens et al.

(10) Patent No.: US 7,726,156 B2
(45) Date of Patent: Jun. 1, 2010

(54) SINKER FOR KNITTING SYSTEM AND KNITTING SYSTEM SHOWING REDUCED WEAR

(75) Inventors: Bob Hagens, Denver, NC (US); Uwe Stingel, Messstetten (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/943,738

(22) Filed: Nov. 21, 2007

(65) Prior Publication Data

US 2009/0126410 A1 May 21, 2009

(51) Int. Cl.
*D04B 15/06* (2006.01)

(52) U.S. Cl. ..... 66/107; 66/104

(58) Field of Classification Search ..... 66/104, 66/105, 106, 107, 108 A, 108 R, 109, 110
See application file for complete search history.

(56) References Cited

U.S. PATENT DOCUMENTS 3,221,521 A 12/1965 Mishcon
4,180,993 A * 1/1980 Philip ..... 66/107
5,244,141 A * 9/1993 Doolittle ..... 29/411
5,564,291 A * 10/1996 Tsai ..... 66/104
6,089,047 A * 7/2000 Wang ..... 66/91
6,269,665 B1 * 8/2001 Wang ..... 66/91
6,286,343 B1 * 9/2001 Sangiacomo ..... 66/217
6,321,575 B1 * 11/2001 Sangiacomo ..... 66/93

FOREIGN PATENT DOCUMENTS

DE 32 41 153 6/1984
DE 195 20 985 12/1996
EP 0 570 340 11/1993
GB 04443 2/1910

* cited by examiner

*Primary Examiner*—Danny Worrell
(74) *Attorney, Agent, or Firm*—Fitch, Even, Tabin & Flannery; Norman N. Kunitz

(57) ABSTRACT

Proposed is a sinker (2) provided with a region (23) of reduced thickness on its working part (9). As a result, a clearance space is created on at least one side of the sinker (2). This clearance space makes it possible to reduce the distance between the sinker (2) and the latch needle (3) or to reduce the wear between these two elements. The clearance space furthermore does not change the distance between the sinker and the latch needle on the other side of the sinker. The sinker (2) according to the invention preferably has a clearance space on both sides, so that this sinker can be used in circular knitting machines which are designed for both rotational directions.

6 Claims, 2 Drawing Sheets

SINKER FOR KNITTING SYSTEM AND KNITTING SYSTEM SHOWING REDUCED WEAR

BACKGROUND OF THE INVENTION

For the production of knitted goods, knitting systems are generally used which can be provided with sinkers. These sinkers operate jointly with needles, for example latch needles, having a latch that is positioned pivoting.

A knitting system of this type is already known from European Patent Application 0 570 340 B1, wherein the sinker for this knitting system consists of a flat metal part with a u-shaped recess. The latch needle is moved past this recess in a direction transverse thereto. Correspondingly, the latch of the latch needle also moves past a defined area of the sinker.

Whenever the sinker and the latch needle come in contact, it can result in wear, particularly if the latch comes in contact with the sinker. The latches of needles, e.g. used in circular knitting machines, are deflected to the side as a result of centrifugal forces and inertial forces, even those on new needles that are still positioned with relatively small play in the needle shank. This deflection increases over the service life of the needle as a result of continued wear and increased latch play. The accompanying increase in wear of the sinker and the latch can make it necessary to replace the sinkers and latch needles. To be sure, the European Patent 0 570 340 B1 proposes to increase the sheet metal thickness of the sinker portion that engages in the sinker cam in order to reduce wear occurring thereon and, instead, to reduce the thickness of the frontal section that comes in contact with the thread. However, the sheet metal thickness in the frontal section cannot be reduced too much because such a reduction is limited by the required stability and/or bending resistance for the sinker and the cutting sensitivity of the threads that are used.

It is therefore the object of the present invention to produce a sinker and/or a knitting system with reduced wear.

SUMMARY OF THE INVENTION

The above object is generally solved according to the present invention with a sinker for a knitting system on a knitting machine, provided with a latch needle with a latch, with the sinker having a body that is formed from a flat metal part and has a working section, which is arranged next to a latch needle during the operation and moves back and forth transverse to a longitudinal direction of the needle, and further having a driving section which engages in a cam during the operation. The working section has at least two thickness regions, with the thickness of the first thickness region being reduced as compared to the thickness of the second thickness region.

A sinker according to the invention and/or a holding-down element according to the invention is, as indicated above, provided with a working section having two regions of varying thickness. The region with reduced thickness in this case is a region across which the latch of an adjacent latch needle moves, either in part or completely, during the knitting system operation.

By providing regions with differing thickness on the working section, it is possible to reduce the wear on the sinker, the needle and the knitting system on the whole. In particular, the distance can be increased between the sinker region with reduced thickness and the back and forth moving latch of a needle that is arranged adjacent in the knitting machine. The danger of contact between the sinker and the latch needle is reduced. In the same way, the wear on the sinker and latch needle is also reduced, which is true even for new needles and particular those with extremely fine needle gauge. The deflection to the side of the latch on a needle and of the needle itself increases over the course of the service life of the needle as a result of increased wear and a greater latch play. This is where the advantages of the sinker according to the invention increase owing to a longer period of use for the sinker and the needle.

The area of transition between the region with higher thickness and the region with lower thickness on the sinker is preferably fixed such that the loops to be held by the sinker are supported by an edge of the sinker region with the higher thickness. For example, the sinker according to the invention is embodied as a knocking over and holding down sinker, with a recess embodied parallel to the top for holding in place a thread or loop, wherein the top closes off with an upper edge. The region with reduced thickness preferably ends at the top edge. The sinker in this case can be offset or at least chamfered on one flat side (one-sided) or on both flat sides (two-sided). Two-sided offset sinkers are preferably used in circular knitting machines, for which the operating movement can correspond to a reciprocating movement, meaning they can turn to the left as well as to the right. In addition, sinkers which are offset on both flat sides are suitable for use in flatbed knitting machines. In contrast, a one-sided thickness reduction can make sense if circular knitting machines have primarily one rotational direction for the operation. The one-sided reduction in that case can be embodied with a greater depth. The reduction in thickness of a two-sided, offset sinker can therefore be embodied on one side only, resulting in more space for the latch deflection.

The sinker can be produced from a sheet metal piece through suitable reshaping or with the aid of a joining process, for example by welding together sheet metal sections of different thickness. Independent of the concrete production method that is selected, it is advantageous to ensure that any transitional edges between the region of reduced thickness and the region or increased thickness are carefully rounded off.

Further details of advantageous embodiments of the invention are the subject matter of the drawing, the specification, or the claims. The specification is limited to essential aspects of the invention and other facts. The drawing supplements the specification.

DETAILED DESCRIPTION OF THE INVENTION

Figure 1:
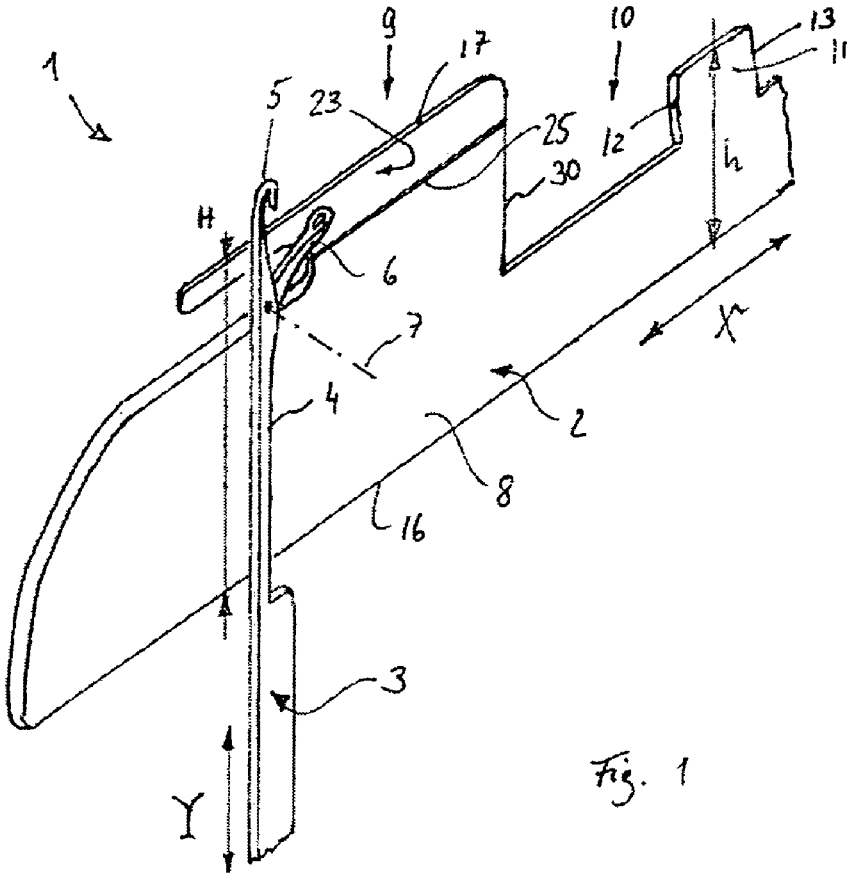
FIG. 1 is a schematic, perspective representation of a knitting system with latch needle and sinker.

The knitting system 1 illustrated in FIG. 1 comprises a sinker 2 and a latch needle 3, which are arranged side-by-side. A knitting machine is generally provided with a plurality of side-by-side arranged knitting systems 1 of this type. The sinker 2 can be arranged, for example, so as to move in a direction X. The latch needle 3 is positioned so as to move in a direction Y. The directions X and Y, for example, are positioned at a right angle to each other. The sinker 2 and the latch needle 3 are positioned in guides, in the form of suitable holders, which are not shown in further detail herein. Holders of this type are knitting cylinders, ripped disks and sinker support rings, for example, of the type that can be found on a circular knitting machine. The sinker 2 can also be arranged at an angle to the latch needle 3, which differs from the angle shown in FIG. 1. Driving means, e.g. in the form of cams, which cause the movement of the knitting tools in the directions X and Y are furthermore assigned to the two knitting tools, meaning the sinker 2 as well as the latch needle 3. The movement courses for the knitting tools are coordinated and can be either along a straight line or a curve.

The latch needle 3 has an elongated shank 4 with a hook 5 at one end and a latch 6 that is arranged near the hook 5 and is positioned on the shank 4 of the latch needle 3 such that it can pivoted around a pivoting axis 7. The sinker 2 has a body 8, consisting of an essentially flat metal part, for example a flat sheet metal part. The body 8 comprises a working part 9 and a driving part 10. The working part 9 cooperates with the loops of the fabric to be knitted and with the latch needle 3. The driving part 10 functions as the drive for moving the sinker 2 in the direction X. The driving part 10 is provided for this with a driving region, for example with therein arranged butt 11.

The height h of the driving region for the exemplary embodiment shown in FIG. 1 is lower than the total height H of the sinker 2. The butt 11 engages in the cam that is not shown in further detail herein. The edges 12 and/or 13, which extend transverse to the direction X and are embodied on the butt 11 and, if applicable, also the edge 30 of the driving region are connected to curved tracks of the cam, so called cam tracks, and move the sinker 2 in the direction X if the cam is moved in a direction relative to the needle bed.

Figure 2:
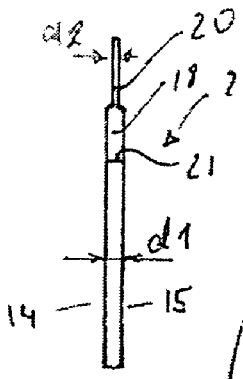
FIG. 2 shows the sinker according to FIG. 1, as seen from the front.

For the present exemplary embodiment, the sheet metal thickness of the working part 9 and the driving part 10 is the same. This thickness d1 is illustrated separately in FIGS. 2 and 4. The thickness d1 must be measured between two preferably parallel flat sides 14, 15 of the sinker 2.

Figure 3:
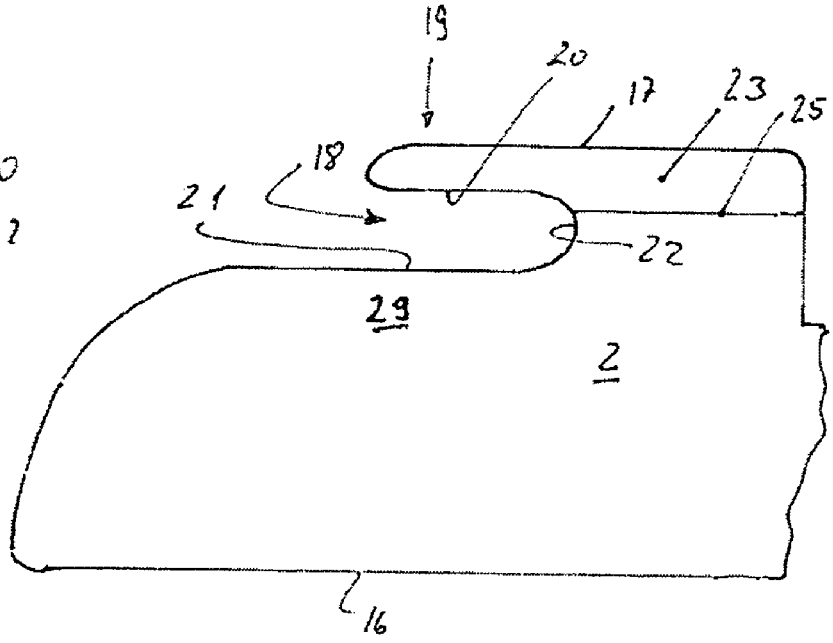
FIG. 3 shows the sinker according to FIG. 1, as seen from the side.

As illustrated in FIGS. 1 and 3, the sinker 2 is provided with a sinker back 16, e.g. a straight back, which is formed by a lower narrow side of the sinker 2. The sinker back 16 is positioned opposite the upper edge 17 of the sinker, which is arranged near the hook 5 of the latch needle 3. Between the upper edge 17 and the sinker back 16, the sinker 2 is provided with a recess 18 in the form of a U-shaped cutout that opens up in the direction X. A projection 19 extends over this mouth-shaped opening, which is delimited on the top by the upper edge 17 of the sinker and on the bottom by a section of the holding-down edge 20 that forms one leg of the U-shaped edge of the recess 18.

Arranged opposite the holding-down edge 20 is a preferably straight and somewhat longer edge 21, the so-called loop-forming part, which forms the other leg of the U-shaped recess 18. A rounded groove 22 is formed between the holding-down edge 20 and the loop-forming edge 21.

Figure 5:
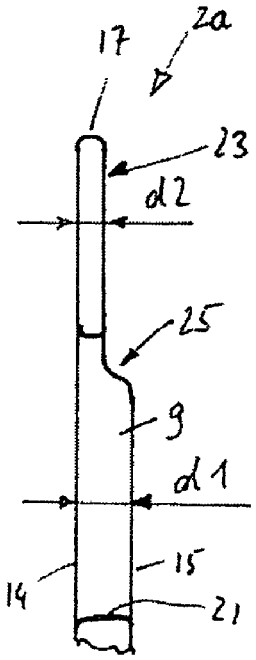
FIGS. 5 and 6 shows alternative embodiments of sinkers in a representation corresponding to FIG. 4.
Figure 4:
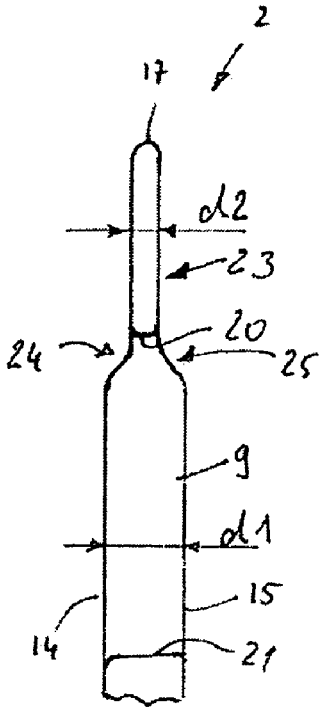
FIG. 4 shows the sinker according to FIG. 2, in an enlarged representation.
Figure 6:
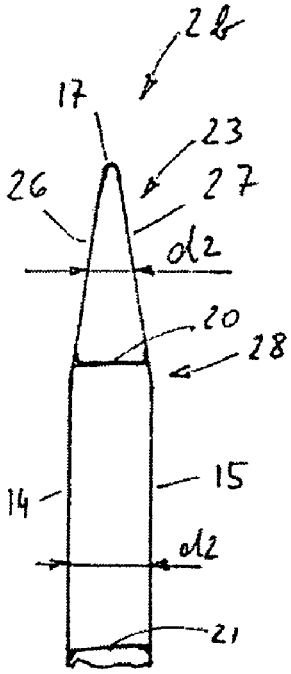

The working part 9 of the sinker 2 has a first region of thickness 23, respectively a zone with reduced thickness d2, as can be seen in FIGS. 4 to 6. This first thickness region 23 is arranged above the loop-forming edge 21. In addition, the working part 9 has a second thickness region 29, for which the thickness exceeds that of the first thickness region 23. The thickness d1 of the loop-forming edge 21, which functions to knock over the loops, therefore exceeds that of the first thickness region 23. The needle 3, in particular with the latch 6, passes by this first thickness region 23 in order to execute a loop-forming movement. As shown especially in FIG. 4, the region 23 transitions to the remaining working part 9, for example via two steps 24, 25. The two steps 24, 25 are preferably at the same level and are oriented parallel to each other. As shown in FIGS. 1 and 3, they can be embodied in the manner of a straight line and are furthermore carefully rounded, as shown in FIG. 4. They can be aligned with the holding-down edge 20 or meet the groove 22, as shown in FIG. 3. They can also be arranged differently, e.g. above the edge 20.

The sinker 2 can meet two different tasks during a knitting operation, such as holding down the knitted fabric and knocking over the loops. In the process, the latch needle 3 is moved in the direction Y, wherein the latch 6 executes a pivoting movement. Owing to the low thickness d2 of the region 23, the danger of the latch 6 making contact with the sinker 2 is reduced or does no longer exist, in particular in the region 23. The wear on the needle and sinker is therefore reduced and the reliability of the knitting system is increased.

The steps 24, 25 have respectively the same width for the embodiment according to FIG. 4. In other words, the working part 9 of the sinker 2 is embodied mirror-symmetrical to an imagined vertical center plane. However, the steps 24, 25 can also have different widths, if necessary, so that the sinker 2 is embodied asymmetrical with respect to the center plane. It may also be sufficient to provide the sinker with only one step on one side, such as is the case for the sinker 2*a* in FIG. 5. The working part 9 of the sinker 2*a* is again provided with two zones having different thicknesses, namely the region 23 with the thickness d2 and the remaining portion of the working part 9 with the thickness d1.

The region 23 with reduced thickness can again extend along the total upper edge 17 of the sinker. In addition, the step 25 preferably is again arranged at the height of the recess 18 or the edge 20. The flat sides 15 as well as the flat sides of the region 23 are oriented in pairs and parallel to each other. However, it is also possible to arrange the side surfaces 26, 27 of the region 23 at an acute angle to each other, as is the case for the sinker 2*b* according to FIG. 6. In that case, the sinker 2*b* is tapered, starting from the point of transition 28 toward the upper edge 17 of the sinker. The region 23 has a wedge-shaped cross section. The steps 24, 25 are omitted or have a reduced height. Otherwise, the above description also applies.

Figure 7:
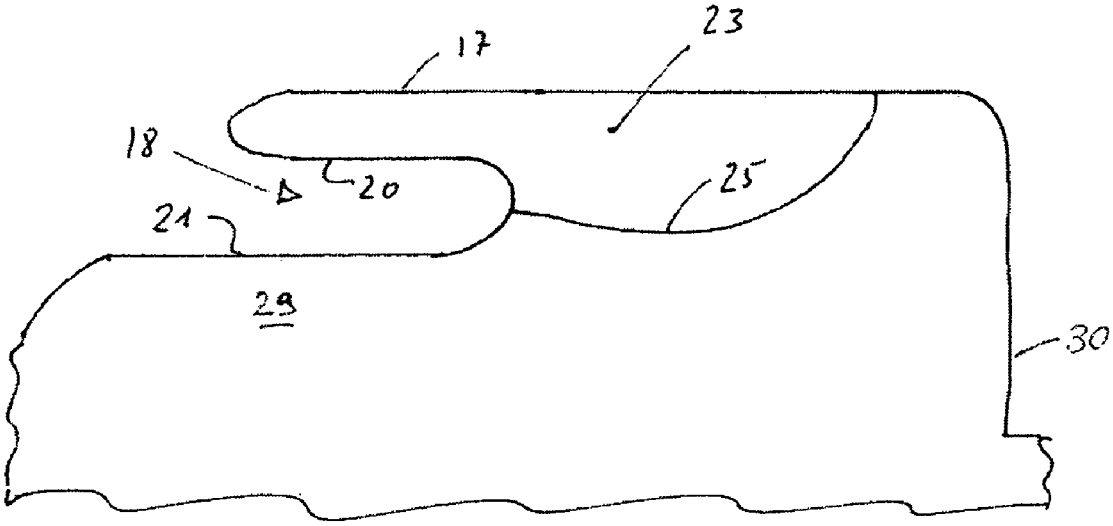
FIG. 7 shows a modified embodiment of the sinker, corresponding to the embodiment shown in FIG. 3.

Numerous modifications are possible. For example, the steps 24, 25 can deviate from the straight line, as shown in FIG. 7. The step 25 can meet the edge of the sinker, either at the upper sinker edge 17 or at another location.

In the same way as for all of the aforementioned embodiments, it is also true in this case that the edge 21, which is embodied as loop-forming edge, is preferably wider. In other words, it has a greater thickness than the edge 20. The edge 21, for example, has a width d2 and thus offers a considerable thread support surface while the edge 20 is correspondingly narrower. The reduced thickness of the region 23 consequently results in reduced wear of the latch needle 3 and in particular of its latch 6. The thread support surface at the edge 21 is rounded and has a width that offers good thread support. The holding-down edge 20 is also rounded so as to be thread-friendly.

One exemplary embodiment according to the invention (not shown herein) can have an additional thickness region, a second thickness reduction in the region of its working part 9. However, the common feature of all embodiments according to the invention is that the region 23 has a lower thickness d2 than the thickness d1 of the loop-forming edge 21, wherein the region 23 is arranged above the loop-forming edge 21. The thickness d2 of the region 23 preferably amounts to one third of the thickness of the loop-forming edge 21. The thickness d2 of the region 23 can amount to half the thickness of the loop-forming edge 21 and for special application cases can be even less. A sinker 2 is proposed with a region of reduced thickness 23 on its working part 9. A working space in the form of a clearance is thus created on at least one side of the sinker 2. This clearance space makes it possible to reduce the spacing between the sinker 2 and the latch needle 3 or to reduce the wear between these two elements. The clearance space furthermore does not affect the distance between the sinker and the latch needle on the other side of the sinker. The sinker 2 preferably has respectively one clearance space on each side, so that the sinker can be used in circular knitting machines, which are designed for both rotational directions.

REFERENCE NUMBERS

1 knitting system
2 sinker
3 latch needle
X, Y directions
4 shank
5 hook
6 latch
7 axis
8 body
9 working part
10 driving part
11 butt
12, 13 edge
d1, d2 thickness
14, 15 flat sides
16 sinker back
17 upper edge of sinker
18 recess
19 projection
20 holding-down edge, edge
21 loop-forming edge, edge, loop-forming section
22 groove
23 first thickness region
24, 25 steps
26, 27 side surfaces
28 transition region
29 second thickness region
30 edge

The invention claimed is:

1. A sinker for a knitting system on a knitting machine, provided with a latch needle with a latch, said sinker having a body that is formed from a flat metal part with flat side surfaces and has a working section, which is arranged next to a latch needle during operation, and which moves back and forth transverse to a longitudinal direction of the needle, and further having a driving section which engages in a cam during the operation, and wherein: the working section has a recess extending in the longitudinal direction of the sinker between a sinker back and a sinker upper edge and having a lower formed-on loop-forming edge and an upper holding-down edge; the working section further has at least two thickness regions as measured between the side surfaces, with the thickness (d2) of the first thickness region being reduced as compared to the thickness (d1) of the second thickness region; the upper holding-down edge is arranged in the first thickness region; and, a transition from the thicker second thickness region to the reduced first thickness region is located entirely at or above said lower formed-on loop forming edge.

2. The sinker according to claim 1, wherein the transition provided between the region with reduced thickness (d2) and the remaining thicker sections of the metal part follows a straight line.

3. The sinker according to claim 1, wherein the transition provided between the region with reduced thickness (d2) and the remaining thicker sections of the metal part is in the form of a step.

4. The sinker according to claim 1, wherein the transition provided between the region with reduced thickness (d2) and the remaining thicker sections of the metal part is provided only at one flat side surface of the metal part.

5. The sinker according to claim 1, wherein the transition provided between the region with reduced thickness (d2) and the remaining thicker sections of the metal part provided on both flat side side surfaces of the metal part.

6. A knitting system for a knitting machine, comprising a latch needle with a needle body having a hook and a latch, which is positioned pivoting on the needle body so as to open up and close off an inside space on the hook, and a sinker as defined in claim 1.

* * * * *